US008066152B2

(12) United States Patent
Tétreault et al.

(10) Patent No.: US 8,066,152 B2
(45) Date of Patent: Nov. 29, 2011

(54) LIQUID COOLING AND DISPENSING DEVICE

(75) Inventors: Martin Tétreault, Chambly (CA); Jean-François Jodoin, Otterburn Park (CA)

(73) Assignee: Ravi Solutions Inc., Longueuil (CA)

( * ) Notice: Subject to any disclaimer, the term of this patent is extended or adjusted under 35 U.S.C. 154(b) by 721 days.

(21) Appl. No.: 11/913,911

(22) PCT Filed: Mar. 20, 2007

(86) PCT No.: PCT/CA2007/000447

§ 371 (c)(1), (2), (4) Date: Jun. 3, 2008

(87) PCT Pub. No.: WO2007/106994

PCT Pub. Date: Sep. 27, 2007

(65) Prior Publication Data

US 2008/0302822 A1 Dec. 11, 2008

(30) Foreign Application Priority Data

Mar. 20, 2006 (CA) ..... 2540426

(51) Int. Cl.
*B67D 7/80* (2010.01)

(52) U.S. Cl. ..... 222/146.6; 222/481.5; 222/567; 62/63; 62/399; 62/434; 62/438; 62/457.8; 165/163; 165/169; 236/132.3

(58) Field of Classification Search .. 137/625.3–625.31; 62/63, 389, 396, 398–400, 430, 438–439, 62/457, 293, 386, 434, 4; 165/163, 169, 165/10; 222/142–142.9, 144, 145.1–145.8, 222/146.1–146.2, 146.6, 189.09, 282, 285–286, 222/460–461, 477, 500, 548–549, 553, 544–545, 222/481.5, 567; 239/132.1–132.3
See application file for complete search history.

(56) References Cited

U.S. PATENT DOCUMENTS

| | | | | | |
|---|---|---|---|---|---|
| 528,463 | A | * | 10/1894 | Busch | 165/73 |
| 1,956,101 | A | * | 4/1934 | Le Noir | 137/625.3 |
| 3,241,724 | A | * | 3/1966 | Lerner | 222/146.3 |
| 3,386,626 | A | * | 6/1968 | Kearney | 222/147 |
| 4,204,613 | A | | 5/1980 | Terziau et al. | |
| 4,407,356 | A | | 10/1983 | DeLau | |
| 4,478,346 | A | | 10/1984 | Spong | |
| 4,599,872 | A | * | 7/1986 | Rist | 62/399 |
| 4,629,096 | A | | 12/1986 | Schroer et al. | |
| 5,004,046 | A | | 4/1991 | Jones | |
| 5,031,831 | A | * | 7/1991 | Williams, III | 239/33 |
| 5,397,031 | A | * | 3/1995 | Jensen | 222/146.5 |
| 5,415,002 | A | | 5/1995 | Koenig | |
| 5,601,217 | A | * | 2/1997 | Wagner | 222/481.5 |
| 5,706,883 | A | | 1/1998 | Ward | |
| 5,897,037 | A | * | 4/1999 | Mann | 222/519 |
| 6,629,430 | B2 | | 10/2003 | Mills et al. | |
| 2005/0269361 | A1 | | 12/2005 | Prabucki | |

* cited by examiner

*Primary Examiner* — Kevin P Shaver
*Assistant Examiner* — Andrew Bainbridge
(74) *Attorney, Agent, or Firm* — Francois Cartier; Robert Brouillette; Brouillette & Partners

(57) ABSTRACT

A device that attaches to a bottle's neck has a base that secures to the bottle's neck and has two passages that traverse the base. The first passage leads to an enclosure located above the base that holds cooling material and optionally has a conduit that improves the heat exchange between a dispensing liquid and the cooling material retained in the enclosure. The exit passage of the enclosure has in at least one embodiment a valve. The second passage through the base forms a vent line that is located entirely below the enclosure and allows air to flow into the bottle as bottle's contents are dispensed through the first passage.

27 Claims, 6 Drawing Sheets

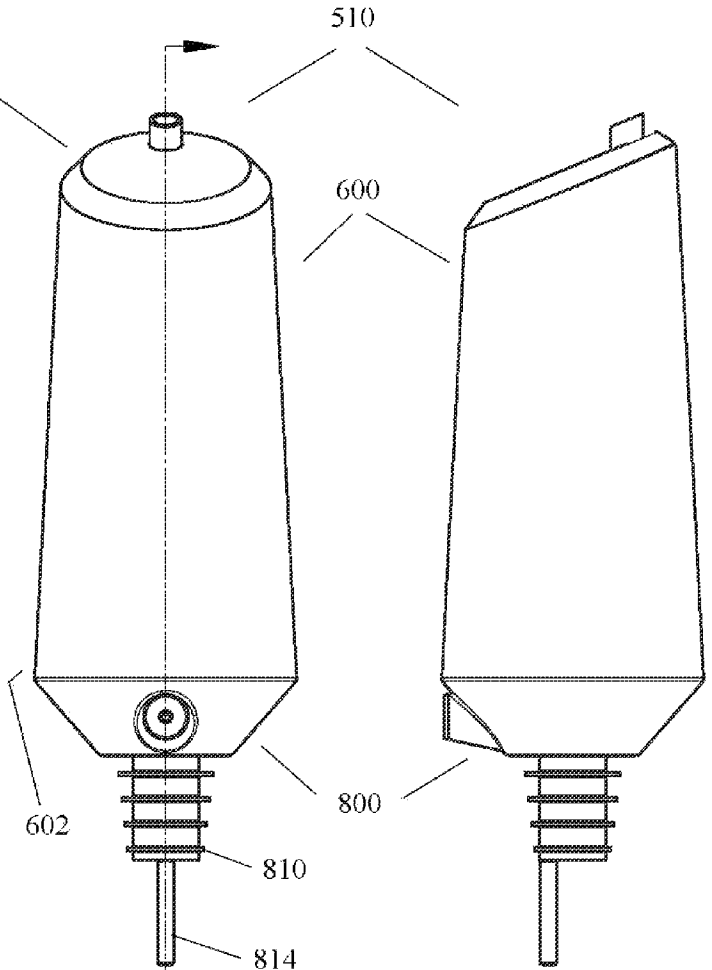
FIG. 6
FIG. 5
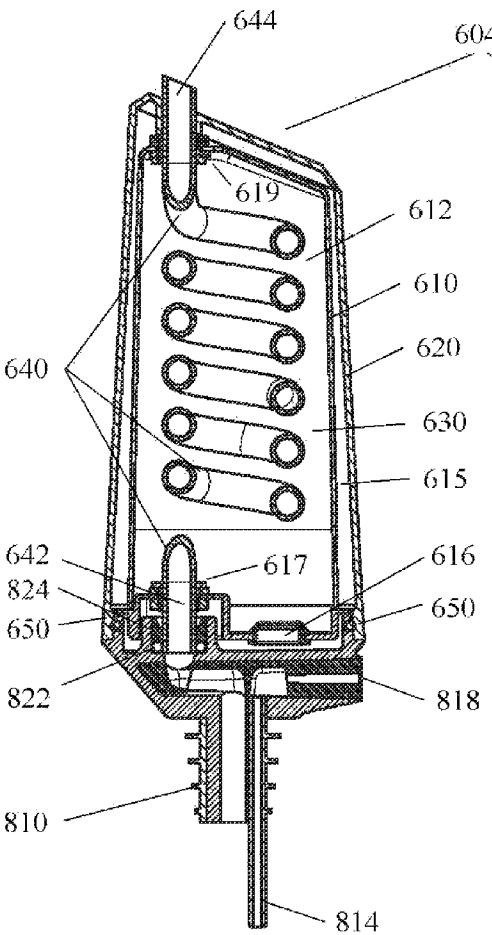
FIG. 7

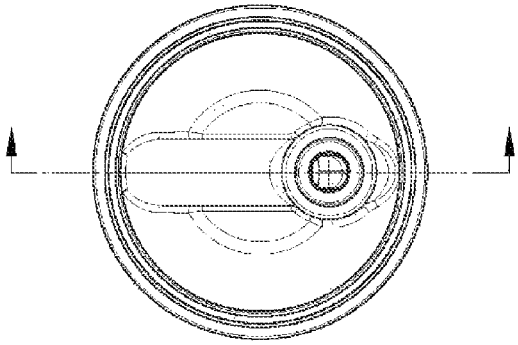
FIG. 10
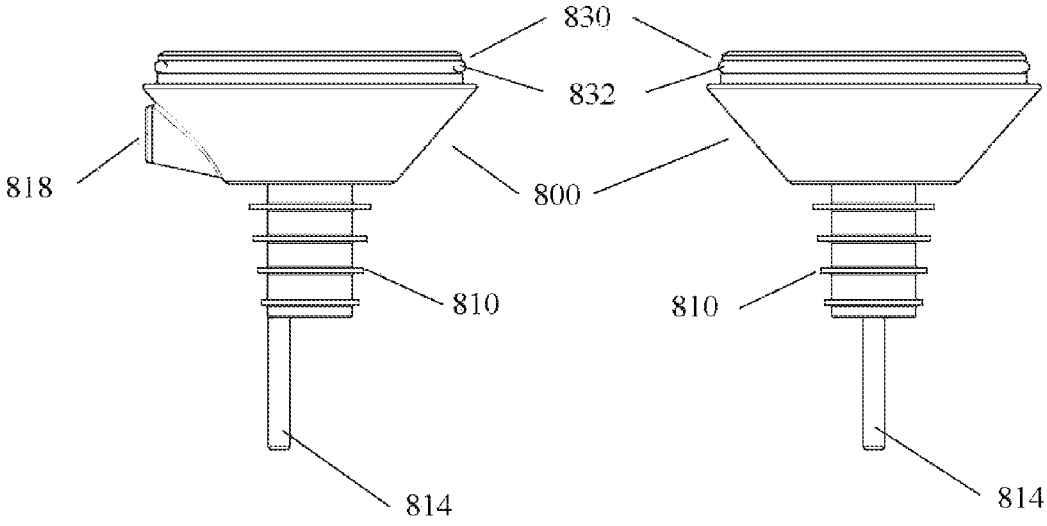
FIG. 8
FIG. 9

LIQUID COOLING AND DISPENSING DEVICE

CROSS-REFERENCE TO RELATED APPLICATIONS

The present patent application claims the benefits of priority of commonly assigned Canadian Patent Application No. 2,540,426, filed on Mar. 20, 2006, at the Canadian Intellectual Property Office and entitled: "Liquid Cooling and Dispensing Device".

FIELD OF THE INVENTION

The present invention generally relates to liquid cooling devices and apparatuses for cooling potable liquid. More particularly, the present invention relates to bottle-mounted liquid cooling devices and apparatuses.

BACKGROUND OF THE INVENTION

It is generally well known that all drinks and beverages are not drunk at the same temperature. Whereas some drinks like soft drinks are generally drunk cold or even ice-cold, some other drinks like tea or coffee are drunk hot. In any case, when a particular drink or beverage is left at room temperature, it will itself eventually reach that same room temperature.

In the case of wines, this is generally to be avoided since wines are generally best tasted at relatively precise temperature. Thus, a bottle of wine which is just out of the cellar and at the perfect temperature will unfortunately reach room temperature if left to its own device, with all the lost in taste and enjoyment.

In order to cool wine, numerous devices have thus been proposed throughout the years. In the vast majority of cases, wine coolers come in the form of a bucket which is filled with ice and water. The bottle of wine is then plunged into the ice and water mixture for cooling. Though these devices can effectively cool a bottle of wine, there is no means to control the final temperature of the wine and the latter generally becomes ice cold.

Thus, to obtain a better control on the cooling, Terziau et al. (U.S. Pat. No. 4,204,613) have proposed a system wherein a coil fluidly mounted to an inverted bottle circulates through a ice filled bucket. The coil is further connected to a valve for dispensing the wine. This system is however bulky and the wine which remains in the coil between two servings will generally become ice cold, which is generally not wanted, particularly for red wines.

Another system, similar to the one of Terziau et al. is the beverage chiller proposed by Rist (U.S. Pat. No. 4,599,872). In the system of Rist, the chiller is directly mounted to a glass. The chiller further comprises an enclosure wherein a coil is disposed through a low freezing cooling material. The coil extends between a funnel for receiving the beverage and an opening leading to the glass. A valve can be provided near the opening. For cooling a beverage, the latter is poured into the funnel and through the coil. As the beverage circulates through the coil, the beverage is cooled. The valve located near the opening can control the retention time of the beverage. As for the device of Terziau et al., the chiller of Rist is bulky and is not adapted for all types of glasses.

The cooler of Busch (U.S. Pat. No. 528,463), which is probably the prior art closest to the present invention, is directly mounted to the neck of a bottle. The cooler of Busch comprises a first enclosure and a second enclosure located within the first. The second enclosure is generally filled with ice. The periphery of the second enclosure is fluted to define a plurality of channels between the first and second enclosures. As the liquid is poured, it circulates through the fluted channels and is thereby cooled by the ice contained in the second enclosure. The cooled liquid then exits the cooler via a nipple aperture. The problem with the cooler of Busch is that there is no way to control the flow of the liquid. Furthermore, there is no venting means to equilibrate the pressure inside the bottle as the liquid is poured, resulting in an unstable flow.

There is therefore a need for a novel liquid cooling and dispensing device which generally obviates or at least mitigates some of the aforementioned shortcomings.

OBJECTS OF THE INVENTION

Accordingly, a primary object of the present invention is to provide a liquid cooling and dispensing device which can cool a liquid.

Another object of the present invention is to provide a liquid cooling and dispensing device which can be mounted directly to a bottle.

Another object of the present invention is to provide a liquid cooling and dispensing device which can control the flow of the liquid.

Other and further objects and advantages of the present invention will be obvious upon an understanding of the illustrative embodiments about to be described or will be indicated in the appended claims, and various advantages not referred to herein will occur to one skilled in the art upon employment of the invention in practice.

SUMMARY OF THE INVENTION

To attain these and other objects which will become more apparent as the description proceeds according to one aspect of the present invention, there is provided a liquid cooling and dispensing device.

The liquid cooling and dispensing device of the present invention generally comprises an enclosure having a lower or bottom portion having at least a first opening and an upper or top portion having a second opening. Generally mounted to the bottom portion and in fluid communication with the first opening is a base or a functionally equivalent element for mounting the device directly to the neck of a bottle, preferably in a sealed arrangement.

Preferably mounted to the top portion of the enclosure and in fluid communication with the second opening is a spout which preferably further comprises a flow control element that can control the temperature of the poured liquid by controlling the actual flow thereof. The flow control element generally comes in the form of a valve but other functionally equivalent flow control element could be used instead. The present invention is not so limited.

A path, which extends between the first and the second openings, is further defined inside the enclosure. Preferably, the path is in the form of a tubular conduit which is surrounded by and is in close contact with low freezing cooling material which has, most preferably, been cooled prior to the use of the device, generally by placing the device in a freezer. Generally, but not exclusively, the conduit is a tube in the form of a hollow helicoidally shaped coil. Most preferably, the material used in the manufacture of the coil is a metal, a metallic alloy, or any other equivalent material which has good heat transfer properties. The device could also have a plurality of conduits for increasing the surface contact area between the conduits and the cooling material.

The liquid cooling and dispensing device of the present invention further comprises a vent tube which is adapted to extend inside the bottle. The vent tube is further in fluid communication with a vent opening located on the side of the enclosure or on the side of the base. The vent tube and the vent opening allow air to enter the bottle as the liquid is poured therefrom. The vent tube and the vent opening therefore equilibrate the internal pressure of the bottle to allow a stable flow of the liquid when the latter is poured.

According to one aspect of the present invention, the vent opening can be closed, for instance, via the thumb or any other finger of the user, to stop the flow of the liquid inside the conduit or conduits and therefore increase the cooling of the liquid by increasing the retention time. Upon removal of the thumb, the liquid would flow again.

According to another aspect of the present invention, the flow control element of the spout can be adjusted to increase or decrease the flow of the liquid upon pouring. By diminishing the flow rate, the retention of the liquid inside the conduit (or conduits) is increased. By increasing the retention time, the contacting time between the liquid in the conduit (or conduits) and the cooling material is also increased, effectively augmenting the cooling of the liquid. Conversely, if the flow rate is increased, the retention time of the liquid inside the conduit (or conduits) is decreased, with a corresponding diminution of the cooling effect. The flow control element of the spout therefore allows the user to adjust the cooling effect of the device to obtain a beverage cooled according to its preferred serving temperature.

The features of the present invention which are believed to be novel are set forth with particularity in the appended claims.

BRIEF DESCRIPTION OF THE DRAWINGS

The above and other objects and advantages and novel features of the present invention will become apparent from the following detailed description of a preferred embodiment illustrated in the accompanying drawings wherein:

FIG. 5 is a front view of a second embodiment of the device of the present invention.

FIG. 6 is a side view of a second embodiment of the device of the present invention.

FIG. 7 is a cross-sectional side view of the second embodiment shown in FIG. 5 along line B-B.

FIG. 8 is a side view of the base of the device of FIG. 5.

FIG. 9 is a rear view of the base of FIG. 8.

FIG. 10 is a top view of the base of FIG. 8.

DETAILED DESCRIPTION OF THE PREFERRED EMBODIMENTS

A novel liquid cooling and dispensing device will be described hereinafter. Although the invention is described in terms of specific illustrative embodiments, it is to be understood that the embodiments described herein are by way of example only and that the scope of the invention is not intended to be limited thereby.

Figure 1:
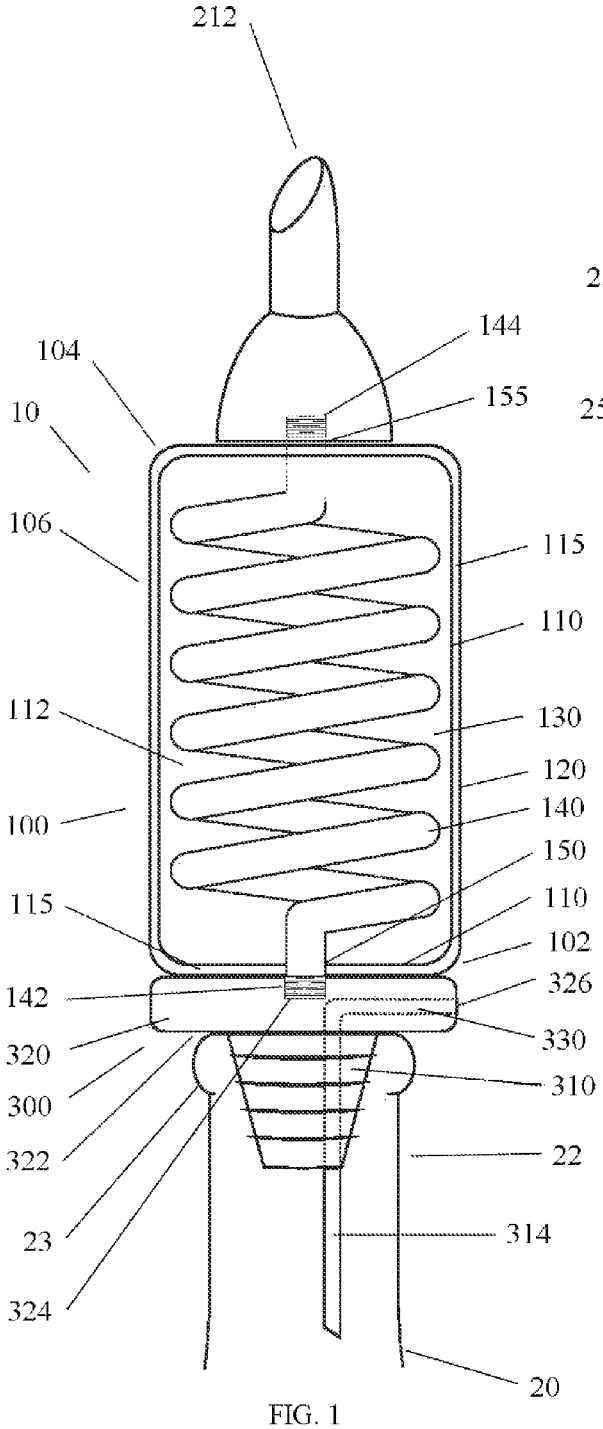
FIG. 1 is a side view of a first embodiment of the device of the present invention as installed on a bottle.

Referring first to FIG. 1, we can see a first embodiment of the liquid cooling and dispensing device 10 of the present invention. As described above, the device 10 is generally used to cool a liquid contained in a bottle 20 as the liquid is poured therefrom. As per the invention, the device 10 is preferably designed to be directly mounted to the neck 22 of a bottle 20 (partially shown in FIG. 1).

In the first embodiment, the device 10 generally comprises three main components, an enclosure 100 to which are mounted a spout 200 and a base 300. The spout 200 and the base 300 are preferably removable in order to ease the cleaning of the device 10.

The enclosure 100 of the device 10 generally comprises an inner wall 110 and an outer wall 120 which define a space 115 therebetween. The inner wall 110 defines an inner chamber 112 which is filled with cooling material 130. For the purpose of the invention, any cooling material having a freezing point preferably lower than 0 degree Celsius can be used. Therefore, the use of gel, saline solutions, alcohols and/or other similar material used in freezing pouches, bags and the like are contemplated and within the scope of the invention.

The space 115 defined between the inner wall 110 and the outer wall 120 is preferably filled with an insulating material in order to prevent or at least slow down the warming of the cooling material 130 by external heat. In a variant of the preferred embodiment, the space 115 is completely sealed and a vacuum is created inside the space 115 to act as insulation. In yet another variant, the space 115 is simply filled with air. The present invention is not so limited.

As seen in FIG. 1, the enclosure 100 generally comprises a bottom portion 102 and a top portion 104. Both bottom portion 102 and top portion 104 are further provided with openings 150 and 155 respectively. In the preferred embodiment, bottom portion 102 is adapted to receive the base 300 whereas the top portion 104 is adapted to receive the spout 200.

In order to allow the passage of the liquid to be cooled from opening 150 to opening 155, both are fluidly connected together via a hollow conduit 140. Preferably, the conduit 140 is a hollow helicoidally shaped coil 140 which extends inside the inner chamber 112 between opening 150 and opening 155. The coil 140 is preferably made of metal, metal alloy or from any other equivalent heat conductive material in order to obtain an efficient heat transfer between the liquid circulating in the coil 140 and the cooling material 130. The conduit 140 is further preferably respectively provided, at each of its extremities 142 and 144, with threads 143 and 145. The threads 143 and 145 are generally used to mounted the base 300 and the spout 200 to the enclosure 100. Still, the base 300 and the spout 200 could be mounted to the enclosure via other forms of mechanical engagement.

Even is only one coil 140 is shown, the skilled addressee will understand that more that one coil 140 could be provided inside the enclosure 100 in order to increase the contact area between the coils 140 and the cooling material 130. Moreover, coil and/or conduit of other shape could also be used.

Furthermore, in a variant of the present invention, the cooling material 130 could be encapsulated in a plurality of sealed capsules (not shown) disposed inside the inner chamber 112. In this variant, the inner chamber 112 itself would act as a path or conduit 140 and the liquid would flow around the cooling capsules (not shown).

As mentioned hereinabove, the device 10 also comprises a base 300 which is securely mounted to the bottom portion 102 of the enclosure 100. The base 300 generally comprises a main portion 320 and a bottleneck portion 310, both of which defining a passage therethrough.

The bottleneck portion 310 is generally adapted to snugly fit in a sealed arrangement into the bottleneck 22 of the bottle 20. In order to create an effective seal, the bottleneck portion 310 is preferably of frustro-conical shape with its outer surface made of rubber or any other equivalent resilient elastomeric material. Therefore, when the bottleneck portion 310 of the base 300 is inserted into the neck 22 of the bottle 20, the outer surface of the bottleneck portion 310 and the inner surface of the neck 22 create a tight seal.

The main portion 320 of the base 300 generally comprises a surface 322 which is adapted to abut on the rim 23 of the neck 22 and therefore prevent the bottleneck portion 310 to be excessively inserted into the neck 22. The main portion 320 also comprises threads 324 matching threads 142 of the coil 140. The base 300 is therefore threadedly mounted to conduit 140. However, as explained above, other forms of mechanical engagement between the base 300 and the enclosure 100 are also possible.

As best seen in FIG. 1, the base 300 further comprises a passage 330 which extends from an venting opening 326 located on the side of the main portion 320 to a vent tubing 314 located the inside of the bottle 20 when the device 10 is installed thereon. The venting opening 326, the conduit 330 and the vent tubing 314 define a passage which allows air to enter in the bottle 20 as the liquid is poured therefrom. As the liquid is poured from the bottle 20, air flows therein to create an equilibrium between the pressure inside the bottle 20 and the pressure outside. This equilibrium allows the liquid to stably flow from the spout 200. However, by voluntarily blocking the opening 326, with a finger for instance, it would be possible to stop the flow of the liquid and retain it inside the conduit 140 for a certain amount of time. By doing so, it would be possible to further cool the poured liquid if necessary or if desired.

Figure 2:
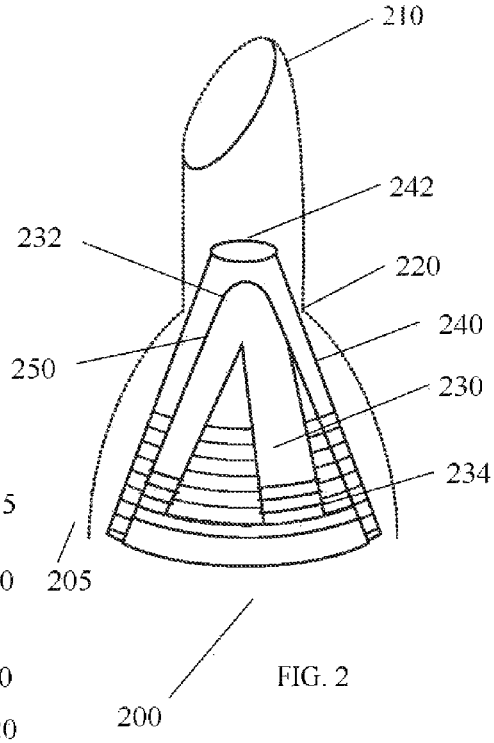
FIG. 2 is a translucent side view of the spout of FIG. 1.

Now referring the FIGS. 1 and 2 and more particularly to FIG. 2, we can see the spout 200 of the device 10. The spout 200 is a generally hollow structure having an opening 212. Located inside the spout 200 is a conical valve 220 itself comprising a first valve member 230 and a second valve member 240 mounted for rotation onto the first valve member 230.

The first valve member 230 is generally fixedly mounted to the threads 144 of the conduit 140 via correspondingly matching threads 235. The first valve member is a hollow conical structure having a preferably round tip 232. The outer surface of the first valve member 230 further comprises a plurality of opening 234 to allow the passage of the poured liquid from the conduit 140 to the opening 212.

The second valve member 240 is preferably a frustro-conical structure which has a top opening 242. The second valve member 240 is slightly larger than the first valve member 230 so that when mounted onto the first valve member 230, the second valve member 240 defines a frustro-conical passage 250 around the first valve member 230 which opens up through the opening 242 of the second valve member 240. This passage 250 allows the circulation of the poured liquid between the openings 234 and the top opening 242. Furthermore, the second valve member 240, which is mounted for rotation onto the first valve member 230, is also generally fixedly attached to the spout 200. Therefore, when the user turns the spout 200, the second valve member 240 rotates with the spout 200.

As it will now be understood, as the valve member 240 rotates with respect with the first valve member 230, it also moves axially with respect with the first valve member 230. Therefore, as the second valve member 240 is rotated, the distance between the opening 242 and the tip 232 changes, enlarging or reducing the passage 250.

Hence, it is possible to control the temperature as well as the flow of the poured liquid by adjusting the distance between the round tip 232 and the opening 242 and thus the size of the passage 250. When the distance between the round tip 232 and the opening 242 is small, the flow of the poured liquid is correspondingly lower. By lowering the flow of the liquid, the retention time of the liquid inside the conduit 140 is increased, further cooling the liquid. On the other hand, if the distance between the round tip 232 and the opening 242 is large, the flow of the liquid will be correspondingly greater with a resulting shorter retention time. This shorter retention time will result in a lesser cooling of the liquid.

It is to be understood that it is possible to rotate the second valve member 240 with respect to the first valve member 230 in order to obtain any intermediate distances between the maximal and the minimal distances between the round tip 232 and the opening 242. Therefore, it is possible to control with a relative degree of precision the flow of the liquid and therefore to adjust the cooling of the liquid to obtain the ideal suggested serving temperature.

Figure 3:
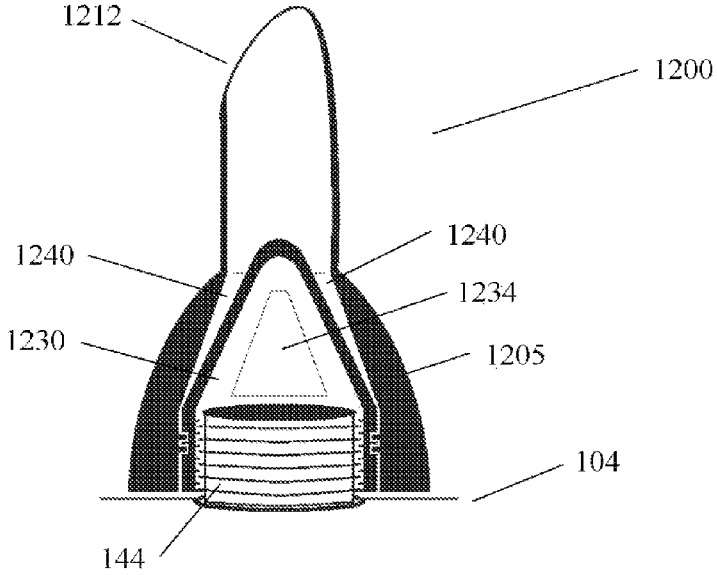
FIG. 3 is a sectional side view of a variant of the spout shown in FIG. 2.

Now referring to FIG. 3, we can see a variant of the valve 220 indicated as 1220. As for valve 220, valve 1220 is generally a conical valve having a first valve member 1230 and a second valve member 1240 pivotally mounted to the first valve member 1230. The first valve member 1230 is generally fixedly mounted to the enclosure 100 via the threads 144 of the conduit 140. The first valve member 1230 generally comprises a plurality of triangular openings 1234 defined in the conical surface of the valve member 1230.

In the embodiment of FIG. 3, the second valve member 1240 is fixedly mounted to the body 1205 of the spout 1200 and preferably disposed over the first valve member 1230. The second valve member 1240 will thus rotate with the body 1205 of the spout 1200. As for the first valve member 230, the second valve member 1240 also comprises a series of openings 1244.

Figures 4A, 4B, 4C:
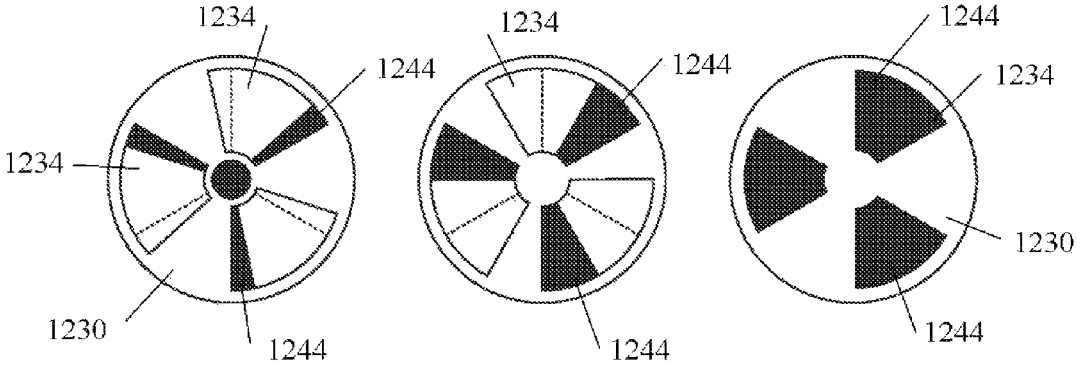
FIG. 4*a* is an underside view of the spout shown in FIG. 3 with the valve in minimal flow adjustment.
FIG. 4*b* is an underside view of the spout shown in FIG. 3 with the valve in intermediate flow adjustment.
FIG. 4*c* is an underside view of the spout shown in FIG. 3 with the valve in maximal flow adjustment.

As will be now understood by referring to FIGS. 4*a* to 4*c*, it is possible to control the flow of the poured liquid by pivotally adjusting the position of the openings 1244 of the second valve member 1240 with respect to the openings 1234 of the first valve member. Referring now to FIG. 4*a*, we can see that the openings 1244 of the second valve member 1240 are only slightly aligned with the openings 1234 and that therefore, the passage defined by the aligned portions of the openings 1244 and openings 1234 is small The flow of the poured liquid will then be correspondingly small. By having a smaller flow, the retention time of the poured liquid inside the conduit 140 will be longer, which will result in a cooler liquid.

On the other hand, as best shown in FIG. 4*c*, if the openings 1244 are fully aligned with the openings 1234, the passage defined by the aligned portions of the openings 1244 and openings 1234 is large. In that case, the flow of the poured liquid would be correspondingly larger which the direct result that the retention time of the liquid in the conduit 140 will be shorter, resulting in a less cooled liquid.

Finally, if the position of the openings 1244 with respect to the openings 1234 is intermediate as shown in FIG. 4*b*, the flow of the liquid would understandably be between the smallest flow (FIG. 4*a*) and the largest flow (FIG. 4*c*).

The skilled addressee will understand that depending on the size of the flow, controlled by the valve 1220 (and also 220), the poured liquid will be more or less cooled by the device 10. The user can therefore adjust the valve 1220 to a particular flow in order to obtain a liquid at a desired temperature.

Depending on the preferences of the users, the adjustability of the valve 1220 (and also 220) can be either continuous, wherein any position between the minimal adjustment and the maximal adjustment are possible, or discreet, wherein only a set of positions are possible between the minimal adjustment and the maximal adjustment.

In a variant of the present device 10, the valves 220 and 1220 could be adjusted to a completely closed position.

Understandably, other flow control system could be used instead without departing from the scope of the invention.

Referring now to FIGS. 5 to 12, a second embodiment of the liquid cooling device of the present is disclosed.

Referring first to FIGS. 5 and 6, the second embodiment 510 of the liquid cooling device generally comprises an enclosure 600 and a base or bottleneck adapter 800 mounted to the bottom portion 602 thereof.

Referring now more particularly to FIG. 7, the enclosure 600 of the second embodiment 510 generally comprises an outer wall 620 and an inner wall 610 which define a space 615 therebetween. The inner wall 610 further defines an inner chamber 612 inside of which extends a preferably metallic tubular coil 640 through which will flow the liquid to be cooled. Understandably, there could be more than one coils 640 and/or the coil 640 could be made of other heat conductive material, the present invention is not so limited.

According to the present invention, in order to cool the liquid as it flows through the coil 640, the inner chamber 612 is further filled with low freezing material 630. For the purpose of the invention, any cooling material having a freezing point preferably lower than 0 degree Celsius can be used. Therefore, the use of gel, saline solutions, alcohols and/or other similar material used in freezing pouches, bags and the like are contemplated and within the scope of the invention. Preferably, the low freezing material is inserted into the inner chamber 612 through a resealable aperture 616 located at the lower portion of the enclosure 600. Understandably, the low freezing material 630 could be permanently stored in the inner chamber 612 though it is generally preferable to have the possibility to remove it in order to clean the enclosure and/ort to prevent bacterial growth.

Still referring to FIG. 7, the space 615 defined between the inner wall 610 and the outer wall 620 preferably acts as an insulating means to prevent heat from reaching the low freezing material 630 located inside the inner chamber 612. Understandably, the spade 615 could be filled with insulating material such as insulating polymeric foam, with air or other inert gases or a vacuum could be created therein. The present invention is not so limited.

Still, in certain variants of the device 510, the outer wall 620 could be demountably mounted to the inner wall 610 in a sleeve arrangement. This would allow the outer wall 620 to be detachable from the enclosure 600 when the latter is stored in a freezer for example. The outer wall 620 could also be detachable from the enclosure 600 for hygienic and/or for cleaning purposes.

The coil 640 which extends within the inner chamber 612 of the enclosure 600 generally comprises a first end 642, extending through the lower portion 602 of the enclosure 600 and adapted to be in fluid communication with the base 800, and a second end 644, extending through the upper portion 644 of the enclosure 644.

Since the low freezing material 630 located inside the inner chamber 612 is likely to be or to become in liquid form, the inner wall 610 is further provided with sealing means 617 and 619, respectively located near the first end 642 and the second end 644 of the coil 640, in order to prevent leaks thereof.

As best seen in FIGS. 7 to 9, the lower portion of the outer wall 620 further comprises a downward circumferential extension 650 which is adapted to be coupled with the seal 832 of the rim 830 of the base 800. Still, other forms of mechanical engagements could be used to mount the base 800 to the enclosure 600 (e.g. threads, clamps, pins, etc.).

Figure 11:
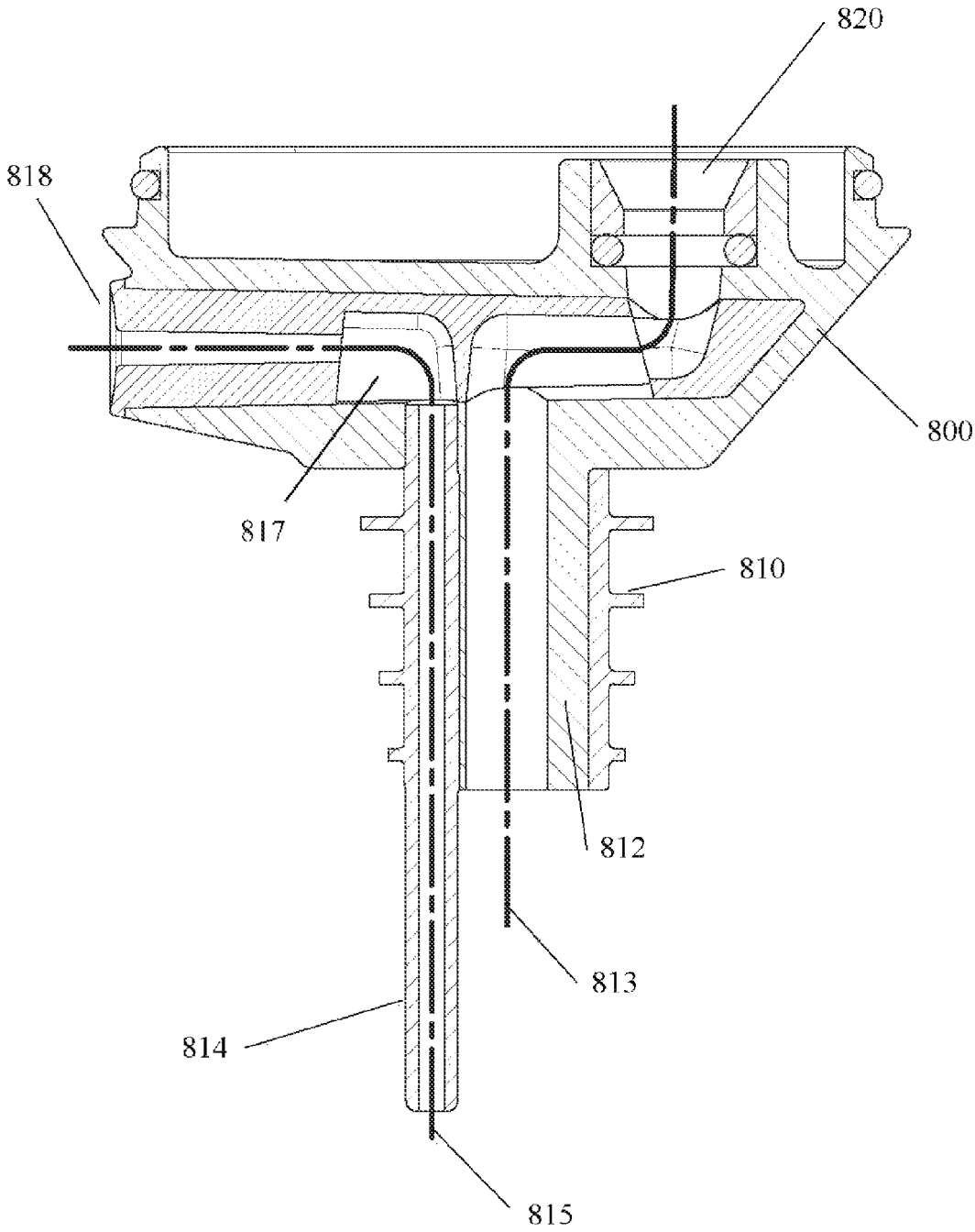
FIG. 11 is a cross-sectional side view of the base of FIG. 8 along lines A-A (see FIG. 10).
Figure 12:
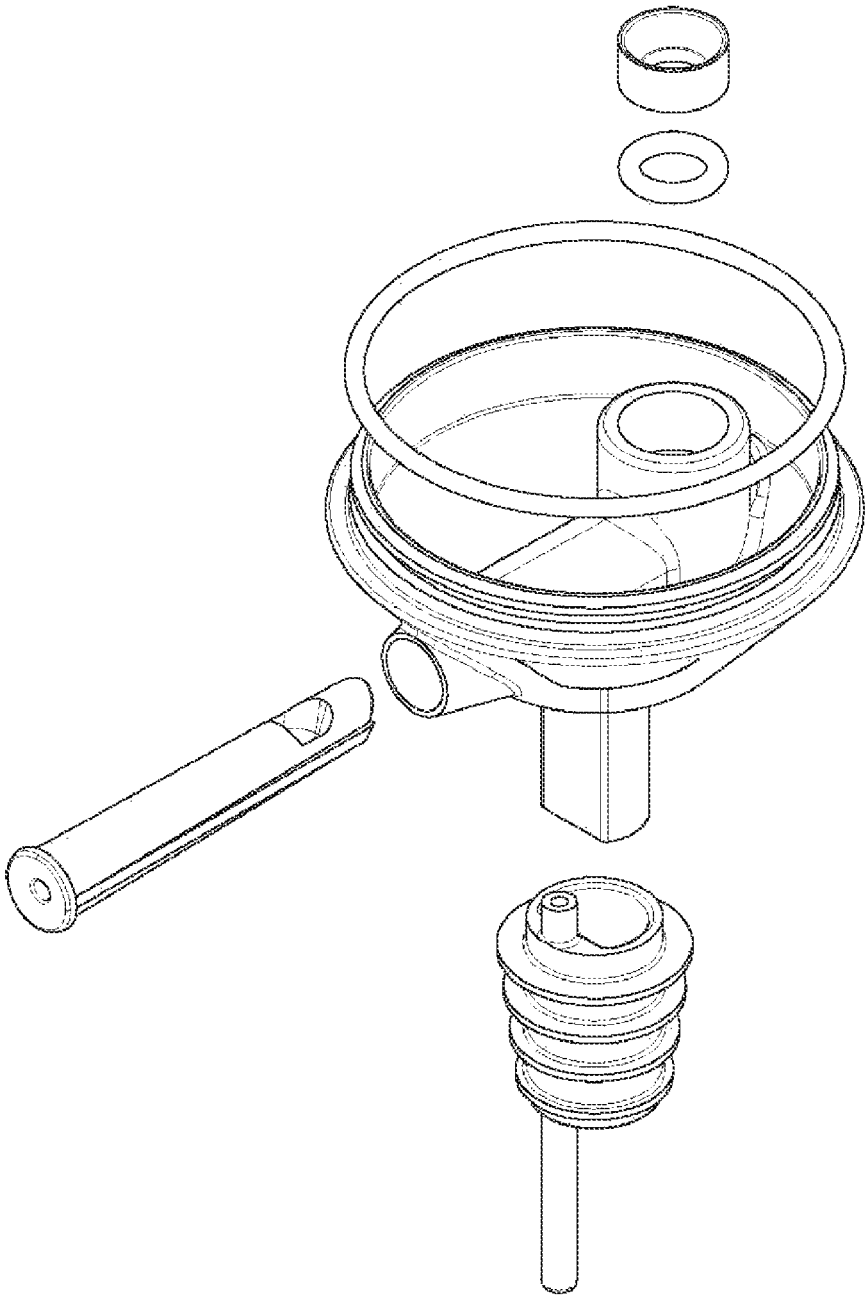
FIG. 12 is a perspective exploded view of the base of FIG. 5.

Referring to FIGS. 7 to 12 and more particularly to FIGS. 8, 9 and 11, the base 800 of the device 510 generally comprises a main portion 802, which is adapted to be mounted to the enclosure 600, and a bottleneck portion 812, which is adapted to extend inside the bottleneck of the bottle (not shown) when the device 510 is mounted thereto.

The bottleneck portion 812 defines a passage 813 allowing the liquid to flow therethrough. Generally mounted to the bottleneck portion 812 is an elastomeric plug 810 which generally comprises a plurality of radially extending ribs generally defining a frustro-conical shape. The plug 810, and the ribs thereof, generally provide a seal arrangement around the bottleneck portion 812 when the latter is inserted into the bottleneck of the bottle (not shown).

In the preferred embodiment, the plug 810 further comprises a vent tubing 814, having a passage 815 therethrough, which is in fluid communication with a venting orifice 818 preferably located on the side of the base 800. The vent tubing 814 and the venting orifice 818 allow air to enter into the bottle as the liquid is poured therefrom, thereby equilibrating the pressure inside the bottle. Additionally, the venting orifice can be used to control the flow of the liquid by partially or totally blocking the orifice with a thumb or any other finger. By slowing or stopping the flow of the liquid inside the coil 640, the contacting time between the liquid and the low freezing material 630 is increased, thereby further cooling the liquid.

Also, as shown in FIG. 11, the passage 815 preferably comprises an enlarged region or chamber 817 intermediate the vent tubing 814 and the venting orifice 818.

In order to allow the liquid to flow from the bottleneck portion 812 to the coil 640, the base 800 also comprises an opening 820 which is in fluid communication with the bottleneck portion 812. The opening 820 is adapted to receive therein the first end 642 of the coil 640. Also, to prevent leaks, the opening 820 is further provided with sealing means 822 and 824 adapted to sealingly engage the first end 642 of the coil 640.

Thus, as the skilled addressee would understand, when the enclosure 600 and the base 800 are mounted together, a continuous flow path exists between the bottleneck portion 812, the main portion 802 and the coil 640, thereby allowing the liquid to flow from the bottle to the glass into which it is poured.

Prior to the use the device 10/510 of the present invention, the device must preferably be put in a refrigerator or in a freezer in order to cool or even freeze the cooling material 130/630. Upon use, the device 10/510 is installed on the neck 22 of a bottle 20 containing a liquid. Then, as the user pours the liquid, the circulation thereof in the conduit 140/640 which in close contact with the cooling material 130/630, effectively cools the liquid.

To adjust the final temperature of the liquid, the user can rotate the spout 200 to effectively set the valve 220/1220 to a particular flow rate, increasing or decreasing the retention time of the liquid in the conduit 140/640. Alternatively or additionally, the user can temporary block the flow of the liquid by closing the venting opening 326/818 with a finger.

In a variant of the present device 10, guide marks could be provided around the base of the spout in order to help the user to obtain a desired temperature.

In yet another variant, the valve 220/1220 of the device 10/510 of the present invention could be automatically actuated, via, for example, a small and preferably battery-powered motor. Still, other actuation mechanisms could be used. This variant would most preferably be equipped with an integrated electronic thermometer and associated electronic processing circuitry. The processing circuitry would automatically actuate the valve 220/1220, via the actuation mechanism, to a particular flow in order to cool the poured liquid from the measured temperature to a predetermined temperature.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A liquid cooling and dispensing device mountable to the neck of a bottle containing a liquid having a first temperature, said device comprising:

a. an enclosure defining an inner chamber, said enclosure comprising a lower portion having a first opening and an upper portion having a second opening;

b. a fluid path defined inside said inner chamber and fluidly connecting said first opening and said second opening;

c. cooling material located inside said inner chamber and in contact with said path;

d. a base mountable to said lower portion of said enclosure, said base being configured to be sealingly mounted to said neck of said bottle, said base comprising a first passage therethrough for fluidly connecting the inside of said bottle to said first opening, and a second passage therethrough for fluidly connecting the inside of said bottle to a venting opening located in said base below the lower portion of said enclosure;

whereby when said liquid circulates through said device, said liquid passes from said first temperature to a second temperature lower than said first temperature.

2. The liquid cooling and dispensing device of claim 1, wherein said path is at least one conduit extending inside said inner chamber between said first opening and said second opening.

3. The liquid cooling and dispensing device of claim 1, wherein said enclosure comprises an inner wall and an outer wall, said inner wall and said outer wall defining a space therebetween.

4. The liquid cooling and dispensing device of claim 1, wherein said base comprises a main portion for abutting on said neck of said bottle and a bottleneck portion, extending from said main portion, for sealingly engaging the inside of said neck of said bottle.

5. The liquid cooling and dispensing device of claim 1, wherein said lower portion of said enclosure comprises a circumferential extension, and wherein said base comprises a circumferential rim configured to engage said circumferential extension.

6. The liquid cooling and dispensing device of claim 2, wherein said at least one conduit is helicoidally shaped.

7. The liquid cooling and dispensing device of claim 2, wherein said at least one conduit is made from heat conductive material.

8. The liquid cooling and dispensing device of claim 7, wherein said at least one conduit is made from a metal or a metal alloy.

9. The liquid cooling and dispensing device of claim 2, wherein said device comprises a plurality of said at least one conduit extending inside said inner chamber between said first opening and said second opening.

10. The liquid cooling and dispensing device of claim 3, wherein said space is filled with insulating material.

11. The liquid cooling and dispensing device of claim 3, wherein said space is filled with air.

12. The liquid cooling and dispensing device of claim 3, wherein said space is sealed and wherein a vacuum is generated inside said space.

13. The liquid cooling and dispensing device of claim 4, wherein said venting opening is located in said main portion, wherein said bottleneck portion further comprises a venting tube mounted thereto and adapted to extend inside said bottle, and wherein said venting opening and said venting tube are in fluid communication via said second passage.

14. The liquid cooling and dispensing device of claim 4, wherein said bottleneck portion comprises an outer surface and wherein resilient material is disposed thereon.

15. The liquid cooling and dispensing device of claim 14, wherein said resilient material is an elastomeric material.

16. The liquid cooling and dispensing device of claim 15, wherein said elastomeric material is rubber.

17. The liquid cooling and dispensing device of claim 13, wherein said second passage comprises an enlarged region intermediate said venting tube and said venting opening.

18. A liquid cooling and dispensing device mountable to a neck of a bottle containing a liquid having a first temperature, said device comprising:

a. an enclosure defining an inner chamber, said enclosure comprising a lower portion having a first opening and an upper portion having a second opening;

b. at least one conduit extending inside said inner chamber and fluidly connecting said first opening and said second opening;

c. cooling material located inside said inner chamber and in contact with said at least one conduit;

d. a base mountable to said lower portion of said enclosure, said base being configured to be sealingly mounted to said neck of said bottle, said base comprising a first passage therethrough for fluidly connecting the inside of said bottle to said first opening, and a second passage therethrough for fluidly connecting the inside of said bottle to a venting opening located in said base below the lower portion of said enclosure;

whereby when said liquid circulates through said device, said liquid passes from said first temperature to a second temperature lower than said first temperature.

19. The liquid cooling and dispensing device of claim 18, wherein said at least one conduit is helicoidally shaped.

20. The liquid cooling and dispensing device of claim 18, wherein said at least one conduit is made from metallic material.

21. The liquid cooling and dispensing device of claim 18, wherein said device comprises a plurality of said at least one conduit extending inside said inner chamber between said first opening and said second opening.

22. The liquid cooling and dispensing device of claim 18, wherein said enclosure comprises an inner wall and an outer wall, and wherein said inner wall and said outer wall define a space therebetween.

23. The liquid cooling and dispensing device of claim 18, wherein said base is located adjacent to said inner chamber.

24. The liquid cooling and dispensing device of claim 23, wherein said lower portion of said enclosure comprises a circumferential extension, and wherein said base comprises a circumferential rim configured to engage said circumferential extension.

25. The liquid cooling and dispensing device of claim 18, wherein said base comprises a main portion for abutting on said neck of said bottle and a bottleneck portion, extending from said main portion, for sealingly engaging the inside of said neck of said bottle.

26. The liquid cooling and dispensing device of claim 25, wherein said venting opening is located in said main portion, wherein said bottleneck portion further comprises a venting tube configured to extend inside said bottle, and wherein said venting opening and said venting tube are in fluid communication via said second passage.

27. The liquid cooling and dispensing device of claim 26, wherein said second passage comprises an enlarged region intermediate said venting tube and said venting opening.

* * * * *